US008200125B2

(12) United States Patent
Tabata et al.

(10) Patent No.: US 8,200,125 B2
(45) Date of Patent: Jun. 12, 2012

(54) APPARATUS AND METHOD FOR IMAGING FORMING USING MODIFIED CONTACT PRESSURE

(75) Inventors: Eiji Tabata, Ibaraki (JP); Atsuto Hirai, Ikoma (JP)

(73) Assignee: Konica Minolta Holdings, Inc., Tokyo (JP)

( * ) Notice: Subject to any disclaimer, the term of this patent is extended or adjusted under 35 U.S.C. 154(b) by 371 days.

(21) Appl. No.: 12/590,241

(22) Filed: Nov. 3, 2009

(65) Prior Publication Data

US 2010/0124428 A1 May 20, 2010

(30) Foreign Application Priority Data

Nov. 18, 2008 (JP) ..... 2008-294210

(51) Int. Cl.
*G03G 15/10* (2006.01)

(52) U.S. Cl. ..... 399/237

(58) Field of Classification Search ..... 399/247, 399/249, 237
See application file for complete search history.

(56) References Cited

U.S. PATENT DOCUMENTS 7,894,755 B2 * 2/2011 Lee ..... 399/284
2007/0140737 A1 * 6/2007 Takano et al. ..... 399/237

FOREIGN PATENT DOCUMENTS

| | | | |
|---|---|---|---|
| JP | 60053970 A | * | 3/1985 |
| JP | 2001-075365 | | 3/2001 |
| JP | 2006-343676 | | 12/2006 |
| JP | 2007-148243 | | 6/2007 |
| JP | 2008-020761 | | 1/2008 |

* cited by examiner

*Primary Examiner* — Quana M Grainger
(74) *Attorney, Agent, or Firm* — Brinks Hofer Gilson & Lione

(57) ABSTRACT

A developing device using a liquid developer removes developer using the contact-rotation between rollers such as a developing roller and thin layer forming roller when an image is not formed, and includes a contact pressure modification section that modifies the contact pressure in the contact region between rollers rotating in contact with one another. When operation is performed to remove the developer using the contact-rotation between rollers with the supply of liquid developer being suspended, modifications are made to ensure that the contact pressure in the contact region is smaller than that during image formation.

11 Claims, 9 Drawing Sheets

APPARATUS AND METHOD FOR IMAGING FORMING USING MODIFIED CONTACT PRESSURE

This application is based on Japanese Patent Application No. 2008-294210 filed on Nov. 18, 2008, in Japanese Patent Office, the entire content of which is hereby incorporated by reference.

TECHNICAL FIELD

The present invention relates to image forming apparatuses and method for image forming, wherein the image forming apparatus includes a developing device, for developing an electrostatic latent image on an image carrier, having a developing roller for carrying liquid developer, a thin layer forming roller, and liquid developer is removed from at least one of the rollers of this developing device when an image is not being formed.

BACKGROUND

There has been extensive use of an image forming apparatus using an electrophotographic process wherein an electrostatic latent image is formed on a photoreceptor (photosensitive drum), and toner is attached thereon, is transferred onto paper and other mediums, and is then fixed. Especially in the image forming apparatus wherein higher image quality and higher resolution are required, as in the field of office printers for high volume printing and on-demand printing apparatuses, a wet type development system has come in use because this system employs a liquid developer that is characterized by reduced toner particle size and minimized toner image disturbances.

One of the proposals made in recent years is an image forming apparatus which uses liquid developer with high viscosity and high concentration which is prepared by dispersing, in high concentration, solid toner made of resin and pigment in an insulative liquid "liquid carrier" such as silicone oil.

When this liquid developer is used for development, generally, a thin layer of the developer on the order of microns is formed on a developer carrier such as a developing roller, and this thin-filmed developer is brought in contact with the photoreceptor as an image carrier, whereby development is performed.

The latent image on the photoreceptor surface is developed with the thin layer of liquid developer and a toner image is formed on the photoreceptor surface. This toner image is transferred onto a recording medium. Alternatively, the toner image is once transferred onto an intermediate transfer member or others and is transferred onto a recording medium. The toner image having been transferred onto the recording medium is pressed and heated by a fixing apparatus and is fixed on the recording medium which is usually a sheet of paper.

The commonly known developing device that develops the latent image on the photoreceptor surface using a liquid developer includes a developer supply section for supplying liquid developer; a thin layer forming roller for forming a thin layer of the supplied liquid and transferring the developer to the developing roller; and a developing roller for carrying the thin layer of liquid developer and developing the latent image on the photoreceptor.

The thin layer forming roller includes one roller or a plurality of rollers such as a supply roller which is dipped in a developer tank as a developer supply section to receive a regulated amount of liquid developer, and a conveyance roller which forms the developer in a thin layer and transfers the developer to the developing roller.

The developing roller and the aforementioned thin layer forming rollers are rotated each in contact with at least one of the other rollers with liquid developer held in between, whereby the liquid developer supplied from the developer supply section is continuously transferred, and a thin layer of the aforementioned developer with a thickness on the order of microns is formed on the developing roller to develop a latent image on the photoreceptor.

For example, the Japanese Patent Application Publication No. 2006-343676 carries the description of the technique on the developing device having the aforementioned structure.

In such a developing device, however, the developer remains on each roller immediately after image formation. If the remaining developer is left for a while, a liquid carrier will evaporate from the developer remaining on the roller, or toner will separate from the liquid carrier, with the result that the percentage of solid toner will increase.

If the remaining developer is left still for a long time as it is, the toner will stick to the roller, and the amount of developer on the roller will not be uniform for the next image forming process. This will cause uneven image density.

In one of the methods proposed to solve this problem, after completion of image formation, for example, the supply roller is separated from the liquid developer in the developer tank not to supply the liquid developer. After that, rollers in contact with one another are driven for a predetermined period of time or longer. In addition, the developer is removed from the roller by a cleaning member (Japanese Patent Application Publication No. 2001-75365, Japanese Patent Application Publication No. 2007-148243 and Japanese Patent Application Publication No. 2008-20761).

This arrangement allows the developer on the supply roller to move to the conveyance roller, and the developer on the conveyance roller to move to the developing roller. Thus, the developer is removed by a cleaning blade of the developing roller. After rotation for a predetermined period of time or longer, there will be no developer on each roller, and there is no concern about the possibility of toner sticking thereto.

Japanese Patent Application Publication No. 2001-75365 discloses a technique of preliminary driving prior to image formation. Japanese Patent Application Publication No. 2007-148243 illustrates the method for removing the developer by driving the rollers, with the developing roller completely separated from the supply roller. Japanese Patent Application Publication No. 2008-20761 describes the method of removing the developer by driving the rollers while applying bias voltage applied between the rollers.

However, according to Japanese Patent Application Publication No. 2001-75365, the proposed method is to perform preliminary driving to level out the accumulated developer on the roller. It is not intended to remove the developer. If the proposed method is aimed at removing the developer, the following problems will arise.

According to the technique disclosed in Japanese Patent Application Publication No. 2007-148243, the proposed method would work well if there were only a developing roller and a supply roller. However, in the case that where are additional rollers provided, unless all those rollers are separated from one another (this arrangement will make removal of the developer difficult), the following problems will also arise.

The method proposed in Japanese Patent Application Publication No. 2008-20761 also has some problems. Regardless of the bias voltages applied between the rollers, since the developer is to be removed by driving the rollers in contact with one other, the following problems will also arise.

To be more specific, to remove the developer, if the supply of developer is suspended and the rollers are driven in contact with one another, the amount of the developer on the peripheral surface of each roller will be reduced as the rollers continue rotating. Then the rollers will rotate in contact with one another, with a reduced amount of developer present on the nip between rollers or without any developer thereon.

A certain contact pressure is applied to the rollers driven in contact with one another in order to restrict the thickness of the thin developer layer during image formation or to transfer the developer from one roller to another. Thus, if rollers are driven in contact with one another having an insufficient amount of developer in the nip between rollers or having no developer at all, the roller surface may be damaged, and more drive torque will be needed.

In particular, the damages on the developing roller surface tend to carry irregular amount of toner or create cleaning problems. This will seriously deteriorate the image quality.

In addition, when the developer on such rollers is removed by cleaning and the rollers start rotating again in the next image formation step, the rollers will be driven in contact with one another having an insufficient amount of developer in the nip between rollers or having no developer at all. This will create the same problem.

SUMMARY

In view of the problems with the prior arts described above, it is an object of the present invention to provide an image forming apparatus equipped with a developing device using liquid developer and method for image forming with the apparatus, with which apparatus and method no trouble can occur due to stuck toner, the surface of the rollers may not be damaged, the required torque for the rollers will not be increased, and thus high image quality is maintained for a long period of time. This object is achieved by sufficiently removing the developer on the rollers by using the contact-rotation of the developing roller and thin film forming roller during no image being formed.

In view of forgoing, one embodiment according to one aspect of the present invention is an image forming apparatus, comprising:

an image carrying member for carrying an electrostatic latent image formed thereon;

a developing device, the developing device including:

a developer supply section for supplying liquid developer containing solvent and toner dispersed in the solvent;

a developing roller for carrying on a surface thereof a thin layer of the liquid developer to develop the electrostatic latent image on the image carrying member;

a thin layer forming roller for transferring the liquid developer supplied from the developer supply section to the developing roller so that the developing roller carries thereon the thin layer of the liquid developer, the developing roller and the thin layer forming roller rotating in contact with each other during an image forming period in which an image forming operation is performed; and a cleaning member for removing the liquid developer from the surface of the developing roller;

a contact pressure modification section for modifying a contact pressure in a contact region in which the developing roller contacts with the thin layer forming roller; and a control section for causing, at a first timing outside the image forming period, the contact pressure modification section to modify the contact pressure in the contact region to be lower than during the image forming period while the developing roller and the thin layer forming roller are kept rotating in contact with each other and the supply of the liquid developer by the developer supply section is suspended.

According to another aspect of the present invention, another embodiment is a method for forming an image by using an image forming apparatus having: an image carrying member for carrying an electrostatic latent image formed thereon; a developer supply section for supplying liquid developer containing solvent and toner dispersed in the solvent; a developing roller for carrying on a surface thereof a thin layer of the liquid developer to develop the electrostatic latent image on the image carrying member; a thin layer forming roller for transferring the liquid developer supplied from the developer supply section to the developing roller so that the developing roller carries thereon the thin layer of the liquid developer, the developing roller and the thin layer forming roller rotating in contact with each other during an image forming period in which an image forming operation is performed; a cleaning member for removing the liquid developer from the surface of the developing roller; and a contact pressure modification section for modifying a contact pressure in a contact region in which the developing roller contacts with the thin layer forming roller, the method comprising the steps of:

causing, outside the image forming period, the cleaning member to remove the liquid developer on the developing roller while the developing roller and the thin layer forming roller are kept rotating in contact with each other with the supply of the liquid developer by the developer supply section being suspended; and modifying, at a first timing in the step of causing the cleaning member to remove the liquid developer, the contact pressure in the contact region between the developing roller and the thin layer forming roller to be lower than during the image forming period.

DETAILED DESCRIPTION OF THE PREFERRED EMBODIMENT

Figure 1:
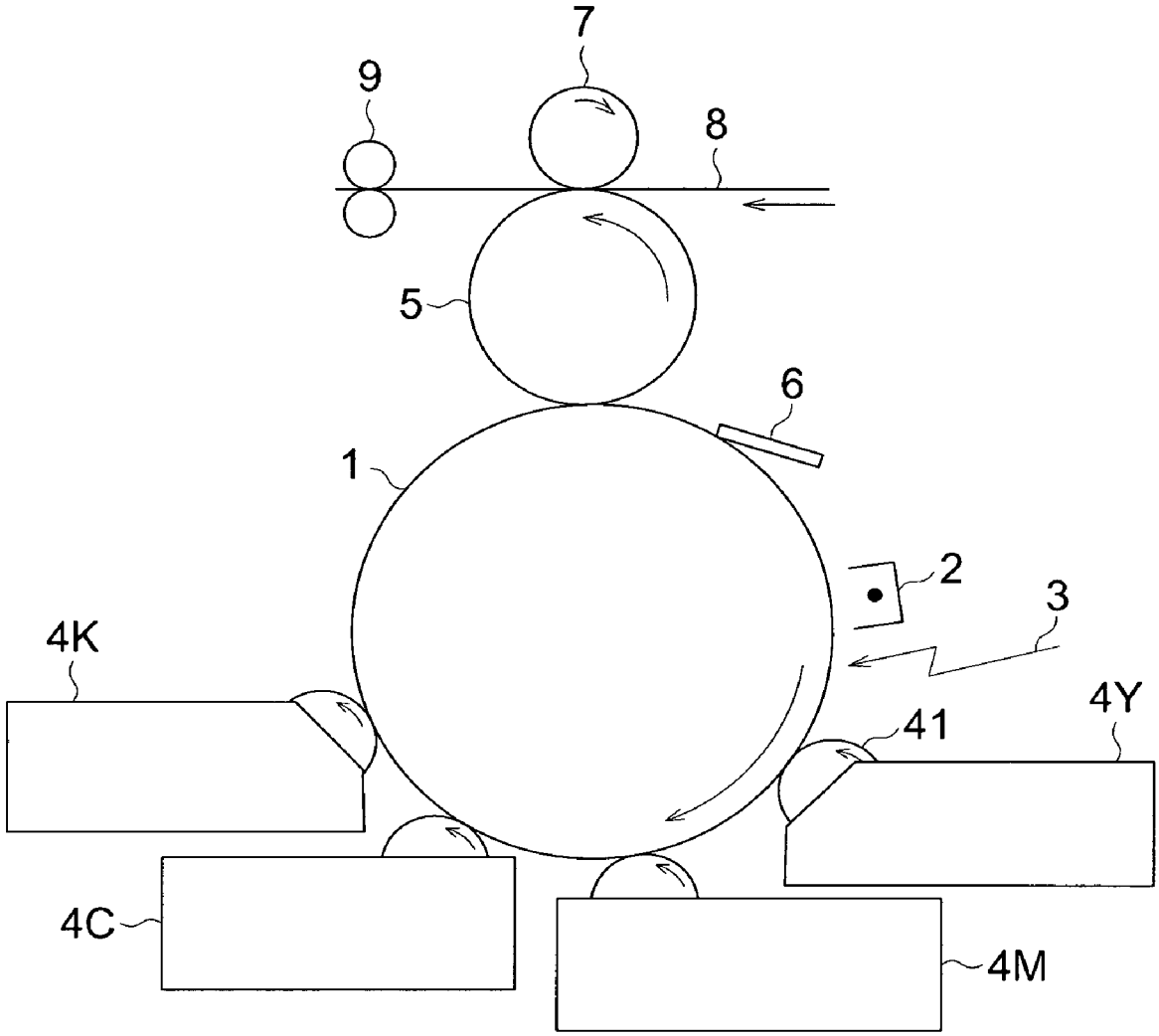
FIG. 1 is a diagram representing an example of a schematic configuration of an image forming apparatus of an embodiment according to the present invention.

Referring to the drawings, the following describes the embodiments of an image forming apparatus and method for image forming according to the present invention.

(Overall Configuration of the Image Forming Apparatus)

FIG. 1 is a diagram representing a schematic configuration example of an image forming apparatus of an embodiment according to the present invention. The following describes the schematic configuration example of the image forming apparatus according to the present invention with reference to FIG. 1.

A charging device 2, exposure device 3, liquid developing devices 4Y, 4M, 4C and 4K, intermediate transfer member 5, and cleaning device 6 are mounted around the photoreceptor 1 as an image carrier in this order in the rotational direction indicated by the arrow. A transfer roller 7 is disposed in the vicinity of the intermediate transfer member 5.

The image receiving member 8 passes through a nip portion between the intermediate transfer member 5 and transfer roller 7, then through a fixing apparatus 9, and is ejected.

The four liquid developing devices 4Y, 4M, 4C and 4K are disposed capable of being in contact with and apart from the photoreceptor 1. Each of these devices is provided with a developing roller 41 whose surface carries a liquid developer, whereby an electrostatic latent image on the surface of the photoreceptor 1 is developed.

Assume that the toner for the liquid developing device 4Y is a yellow toner, the toner for the liquid developing device 4M is a magenta toner, the toner for the liquid developing device 4C is a cyan toner, and the toner for the liquid developing device 4K is a black toner. A toner image of each color is formed in each liquid developing device, and those images are superimposed on the surface of the intermediate transfer member 5. After that, images are collectively transferred onto the image receiving member 8, whereby a full color image is formed.

The detailed configuration of each liquid developing device will be described later.

(Operation of the Image Forming Apparatus)

The operation of the image forming apparatus in FIG. 1 will be described one by one.

The photoreceptor 1 rotates in the direction of the arrow. First, the surface of the photoreceptor 1 is uniformly charged by the charging device 2 to a predetermined surface potential. After that, the surface of the photoreceptor 1 is exposed by the exposure device 3 based on an image information to form an electrostatic latent image thereon.

Then the liquid developing device 4Y is placed opposed to the photoreceptor 1, and the liquid developer carried on the surface of the developing roller 41 is brought in contact with the photoreceptor 1 to develop the electrostatic latent image, whereby a yellow toner image is formed on the surface of the photoreceptor 1.

The liquid developer used for the liquid developing devices 4Y, 4M, 4C and 4K is prepared by dispersing toner particles in an insulating liquid carrier. The liquid developer can also contain a function-adding agent such as a charge control agent or dispersant.

It is preferred to use a liquid developer with a high density and high viscosity wherein solid ingredient such as toner particles is dispersed at a ratio of 10 through 50 parts by mass, and the viscosity at 25° C. is in the range of 1 mPa·s through 10000 mPa·s. The toner particles are positively charged by the charging member (not illustrated in FIG. 1) in advance.

A further rotation of the photoreceptor 1 allows the toner image on the surface to be conveyed to the primary transfer region where the photoreceptor 1 is in contact with the intermediate transfer member 5. A negative voltage is applied to the intermediate transfer member 5 from a power source (not illustrated), and the toner is moved by the field produced by application of this voltage, whereby the toner image on the surface of the photoreceptor 1 is primarily transferred to the surface of the intermediate transfer member 5.

After the primary transfer, liquid developer remaining on the photoreceptor 1 is removed by a cleaning device 6, and the surface of the photoreceptor 1 is again charged uniformly by the charging device 2 to the predetermined surface potential. The intermediate transfer member 5 can be designed in the shape of either a drum or belt.

This is followed by a step of forming an electrostatic latent image again on the surface of the photoreceptor 1. Development is made by the liquid developing device 4M, and a magenta toner image is formed on the surface of the photoreceptor 1. The magenta toner image is then primarily transferred onto the surface of the intermediate transfer member 5, and a yellow toner image and magenta toner image are superimposed on the surface of the intermediate transfer member 5.

Similarly, the cyan toner image developed by the liquid developing device 4C and the black toner image developed by the liquid developing device 4K are also superimposed. Thus, a full color toner image is formed on the surface of the intermediate transfer member 5.

As the intermediate transfer member 5 is driven in the direction of the arrow, the full color toner image formed on the surface of the intermediate transfer member 5 is conveyed to the secondary transfer region where the intermediate transfer member 5 is in contact with the image receiving member 8.

In the secondary transfer region, a linear pressure is applied between the intermediate transfer member 5 and image receiving member 8 by the transfer roller 7 located on the back surface of the image receiving member 8 and, at the same time, a negative voltage is applied to the transfer roller 7 from a power source (not illustrated).

The surface of the image receiving member 8 opposed to the intermediate transfer member 5 is charged to have a negative potential by the application of this voltage. The toner image is attracted to the surface of the image receiving member 8 by the difference between the surface potential of the image receiving member 8 and that of the intermediate transfer member 5. Under this condition, the image receiving member 8 is conveyed in the direction of the arrow. The secondary transfer of the toner image onto the image receiving member 8 terminates when the image receiving member has come out of the secondary transfer region.

The image receiving member 8 to which the toner image has been transferred is subjected to a fixing process by the fixing apparatus 9, whereby the image output operation terminates.

(Structure, Operational, and Function of the Liquid Developing Device)

Configuration Example 1

Figure 2:
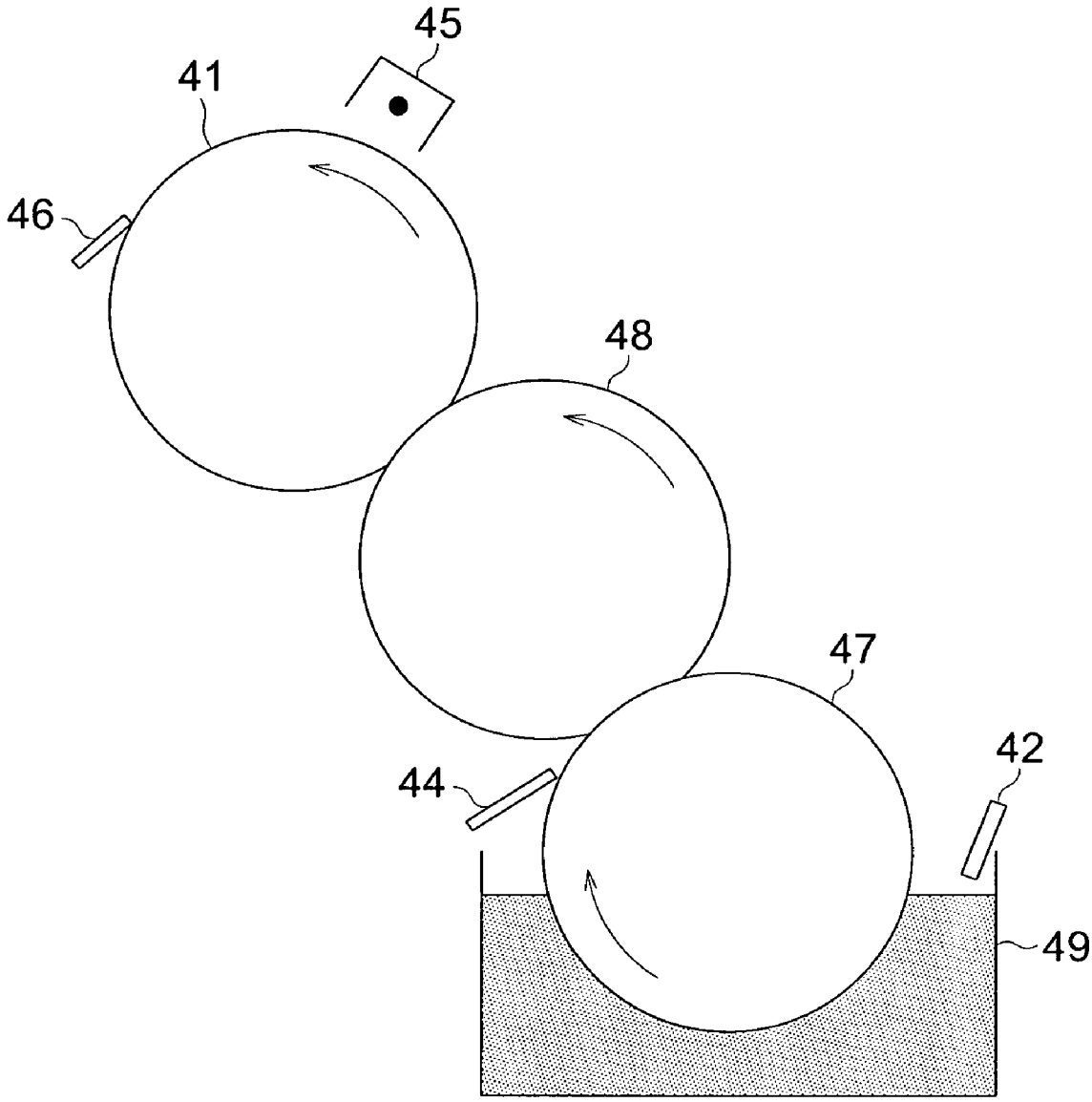
FIG. 2 is a diagram representing a schematic configuration example 1 of the developing device 4 used in the image forming apparatus of FIG. 1.

FIG. 2 is a diagram representing a schematic configuration example 1 of the developing device 4 used in the image forming apparatus of FIG. 1. Referring to FIG. 2, the following describes the schematic configuration example 1 of the developing device and operations as well as functions thereof.

A supply nozzle 42 is installed to supply liquid developer to the developer tank 49 for storing the liquid developer. The liquid developer is supplied by a pump through the pipe from a developer storage tank (not illustrated).

A part of the supply roller 47 is dipped in the liquid developer inside the developer tank 49, and the rotation of the supply roller 47 pumps up the liquid developer by attaching the liquid developer to the surface of the supply roller 47. Thus, in this configuration example 1, the developer tank 49 serves as a developer supply section.

Above the supply roller 47 pumping up the liquid developer, the developer regulating blade 44 is disposed in contact or with an appropriate gap therebetween with the developing roller 47, and excessive developer is scraped off, and only the appropriate amount of developer is allowed to pass through.

The liquid developer regulated to an appropriate amount is once transferred onto a conveyance roller 48 driven in contact with the supply roller 47, and is leveled out to form a thin layer of developer. As described above, the supply roller 47 and conveyance roller 48 serve as thin layer forming rollers.

A thin layer of developer on the surface of the conveyance roller 48 is further transferred to the developing roller 41 as a developer carrier driven in contact with the conveyance roller 48, and is carried as a thin liquid developer layer on the developing roller 41.

The thin liquid developer layer formed and carried on the developing roller 41 is electrically charged by the corona charging device 45 as a charging member which is applied with a toner charging voltage by a voltage application device (not illustrated). This arrangement charges the toner in the thin layer, and the charge held by the toner facilitates and ensures the development of the electrostatic latent image and transfer of the toner image.

It should be noted that if a sufficient amount of electric charge is retained on the toner, the charging device 45 can be omitted.

To develop the electrostatic latent image with the charged toner, a development bias voltage is applied to the developing roller 41 by a voltage application device (not illustrated). The toner in the thin developer layer on the developing roller 41 is supplied to develop the electrostatic latent image on the photoreceptor 1, whereby the aforementioned visible toner image is formed.

The liquid developer that has not been consumed on the developing roller 41 is removed by the cleaning device 46. The cleaning device 46 uses a cleaning blade as a cleaning member.

An elastic roller or a metallic roller can be used as the supply roller 47. It is preferred to use an anilox roller, on the surface of which roller recessed portions are provided with recessed portions which can hold and transfer liquid developer, and the amount of the liquid developer conveyed in the recessed portions is stably regulated. Further, as the developing roller 41 and conveyance roller 48, there is preferably used a conductive roller which is formed of an elastic material such as a urethane rubber or NBR rubber and has a hardness of 30 through 80 degrees.

Configuration Example 2

Figure 3:
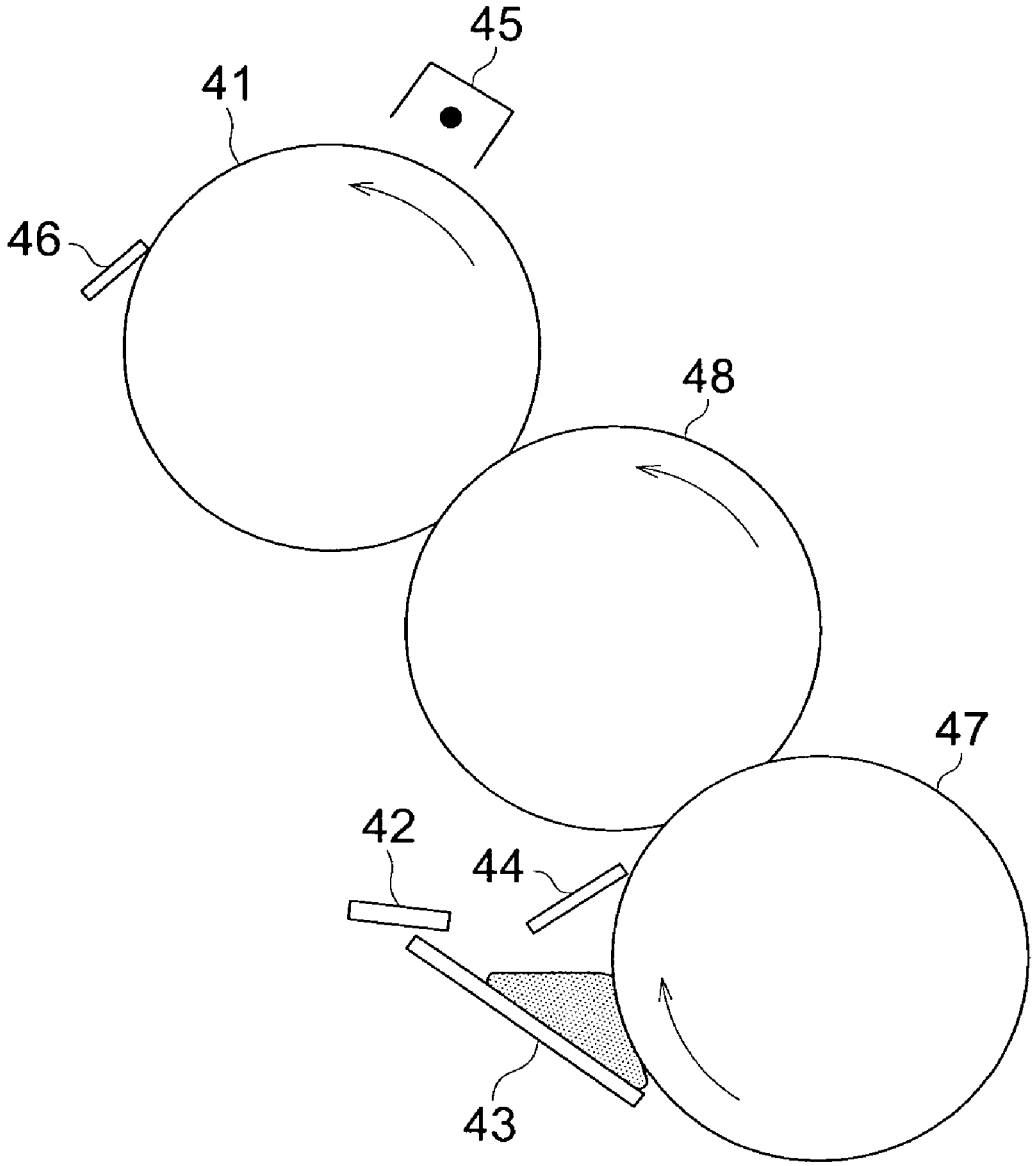
FIG. 3 is a diagram representing another schematic configuration example 2 of the developing device 4 used in the image forming apparatus of FIG. 1.

FIG. 3 is a diagram representing an schematic configuration example 2 of a developing device 4 used in an image forming apparatus of FIG. 1. Referring to FIG. 3, the following describes the schematic configuration example 2 of the developing device in the present embodiment.

The difference between the configuration example 2 of the developing device and the apparatus of FIG. 2 is only in the supply section for supplying liquid developer to the supply roller 47.

A developer supply blade 43 is provided opposed to the supply roller 47 so as to form a liquid reservoir portion in contact with the supply roller 47. This developer supply blade 43 serves as a developer supply section.

A supply nozzle 42 to which liquid developer is supplied from the developer storage tank (not illustrated) is provided close to the end, of the developer supply blade 43, opposite to the end facing the supply roller 47 of the developer supply blade 43.

The developer supply blade 43 has an appropriate angle such that the side closer to the supply roller 47 is lower than the other. The leading edge portion is in contact to the supply roller 47, or is close thereto with an appropriate gap therebetween. The liquid developer reservoir portion is created in the region having wedge-like shape formed between the developer supply blade 43 and supply roller 47.

The advantage in the use of the configuration example 2 in FIG. 3 is that the developing device can be downsized, compared to the configuration example 1 of FIG. 2.

Configuration Examples 3 and 4

Figure 4:
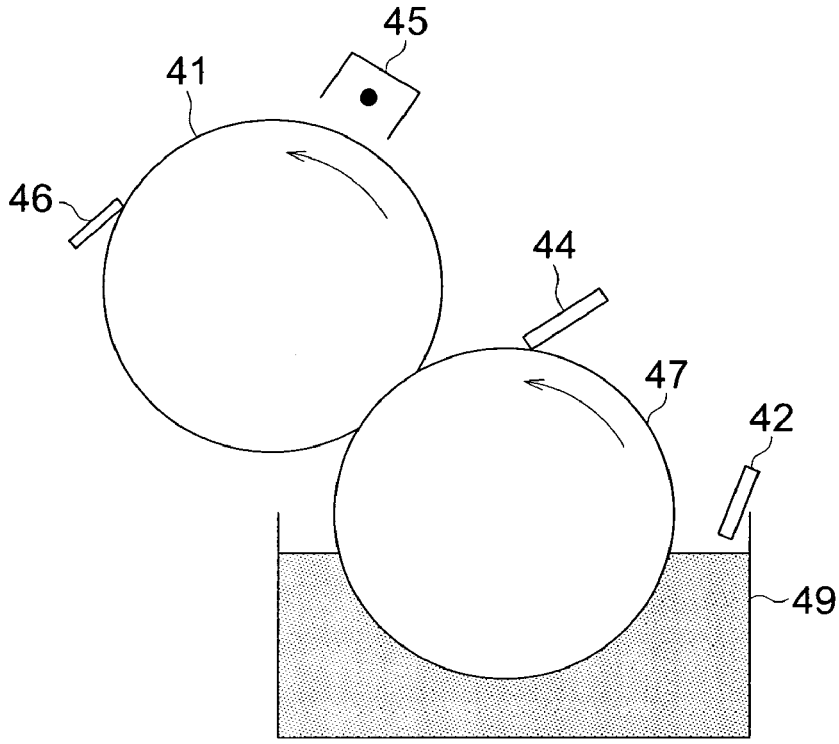
FIG. 4 is a diagram representing another schematic configuration example 3 of the developing device 4 used in the image forming apparatus of FIG. 1.
Figure 5:
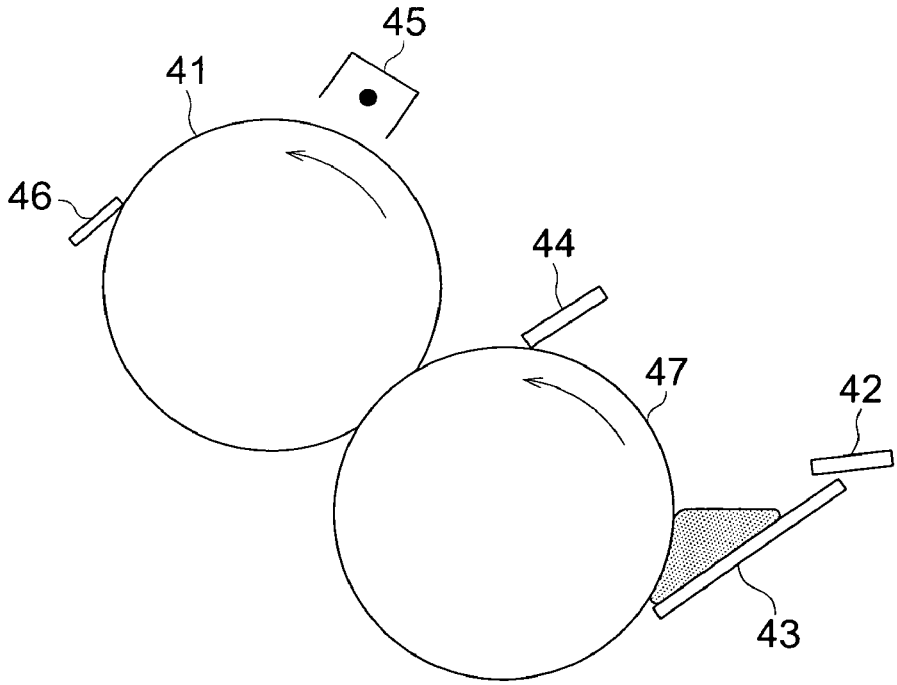
FIG. 5 is a diagram representing another schematic configuration example 4 of the developing device 4 used in the image forming apparatus of FIG. 1.

FIG. 4 and FIG. 5 are diagrams representing another schematic configuration examples 3 and 4 of a developing device 4 used in the image forming apparatus of FIG. 1. Referring to FIG. 4 and FIG. 5, the following describes the schematic configuration examples 3 and 4 of the developing device of the present embodiment.

The developing devices of the schematic configuration examples 3 and 4 are different from those of FIG. 2 and FIG. 3 in that the liquid developer is transferred directly from the supply roller 47 to the developing roller 41 without using the conveyance roller 48. This provides an advantage of downsizing of the apparatus since the conveyance roller 48 is eliminated.

In these configuration examples 3 and 4, a conveyance roller 48 is not used. Accordingly, only the supply roller 47 serves as a thin layer forming roller.

Configuration Example 5

Figure 6:
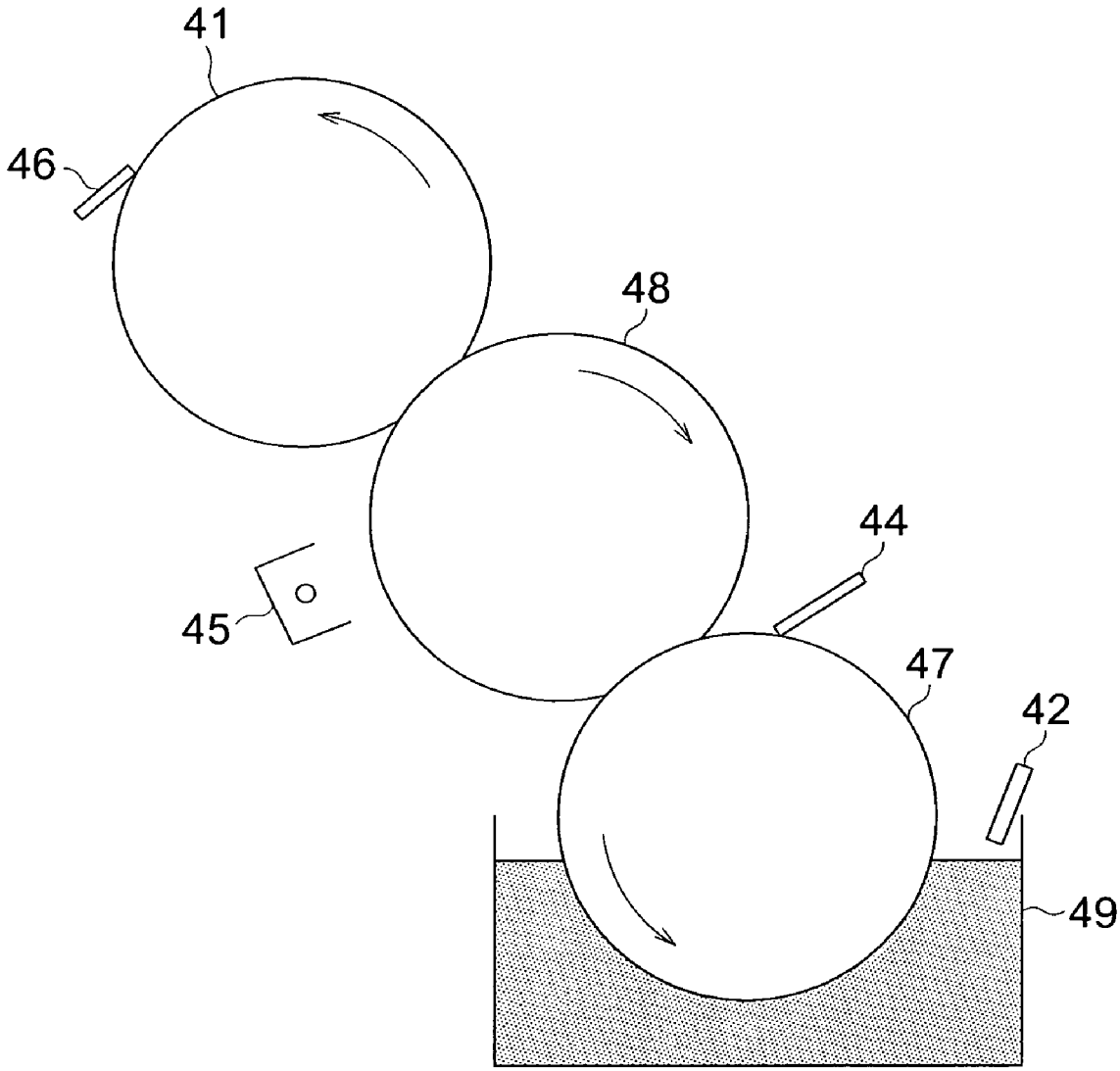
FIG. 6 is a diagram representing another schematic configuration example 5 of the developing device 4 used in the image forming apparatus of FIG. 1.

FIG. 6 is a diagram representing still another schematic configuration example 5 of the developing device 4 used in the image forming apparatus of FIG. 1. The following describes the schematic configuration example 5 of the approximate configuration of the developing device of the present embodiment with reference to FIG. 6.

The difference between the developing device in this configuration example 5 and that of FIG. 2 is that the direction of rotation of the rollers driven in contact is different. This also means a difference in the layout position of the corona charging device 45.

In the apparatus of the configuration example 5 of FIG. 6, the developing roller 41 and conveyance roller 48 rotate in the same direction at the position of contact. Thus, although the required rotational torque can be reduced, transfer of the liquid developer from the conveyance roller 48 to the developing roller 41 is not sufficient.

To assist the transfer, the corona charging device 45 is installed above the conveyance roller 48, and toner is charged on the conveyance roller 48. Voltage is applied between the developing roller 41 and conveyance roller 48 from the voltage application device (not illustrated), and the toner charged by this voltage is transferred to the developing roller 41.

The advantage of this structure is that, since the toner charged with voltage is transferred, toner can be transferred at a sufficiently high rate, and the required torque can be reduced, even if the developing roller 41 and conveyance roller 48 are driven in the same direction.

(Contact Pressure Between Rollers and Change Thereof>

<Contact Pressure During Image Formation Process>

Referring to FIG. 2 through FIG. 6, the above description has described various forms of configuration examples of the developing device 4 in FIG. 1. In any of the cases, the contact pressure between rollers must be set to an appropriate level for the purpose of ensuring transfer of the liquid developer and uniform formation of a thin layer.

If contact pressure between the developing roller 41 and conveyance roller 48 (supply roller 47 in FIGS. 4 and 5) is too small, part of the developer on the conveyance roller 48 will pass through the nip portion with the developing roller 41.

Only the amount of the developer that has not passed through the nip portion between the developing roller 41 and conveyance roller 48 is transferred onto the developing roller 41. This amount is smaller than desired. In this case, the amount of developer used for development will be insufficient and a faint image with reduced density will be outputted.

Conversely, if the contact pressure between the developing roller 41 and conveyance roller 48 is excessive, the required torque for the rollers will increase, and driving will be unstable. Thus, the amount of the developer on the developing roller 41 will be uneven. This will cause an image to contain a striped noise.

Thus, when the contact pressure between the developing roller 41 and conveyance roller 48 is set to the appropriate level, a uniform thin developer layer with an appropriate amount of developer can be formed on the developing roller 41.

<Contact Pressure in the Roller Cleaning Operation>

In the meantime, liquid developer remains on each roller immediately after termination of the image formation step, as described above. If this condition is left as is for a long time, toner will stick to the roller and the amount of developer will be uneven in the next image formation step. To address this issue, after completion of image formation, rotation is performed to clean the roller surface.

In the image forming apparatus of the present embodiment, it should be noted that during the roller cleaning operation, the contact pressure between rollers is changed and set at a level lower than the contact pressure during the image formation process described above.

That operation is performed to prevent the surface of the rollers from getting damaged or the required torque for the rollers from getting increased in the above-described situation that during the roller cleaning operation, there is only a little amount of liquid developer or no liquid developer at all on the surface of the rollers, although rollers are driven in contact through the liquid developer, in the image forming operation.

<Contact Pressure Adjusting Mechanism>

In the present embodiment, a contact pressure adjusting mechanism for adjusting the contact pressure between the rollers is provided as a contact pressure modification section, although this was not illustrated in the approximate configuration diagram of the developing device in FIG. 2 through FIG. 6.

The contact pressure adjusting mechanism is structured in such a way as to adjust the contact pressure at the position of contact at least between the developing roller and thin layer forming roller. This contact pressure adjusting mechanism allows the contact pressure to be changed during the roller cleaning operation.

Figure 7:
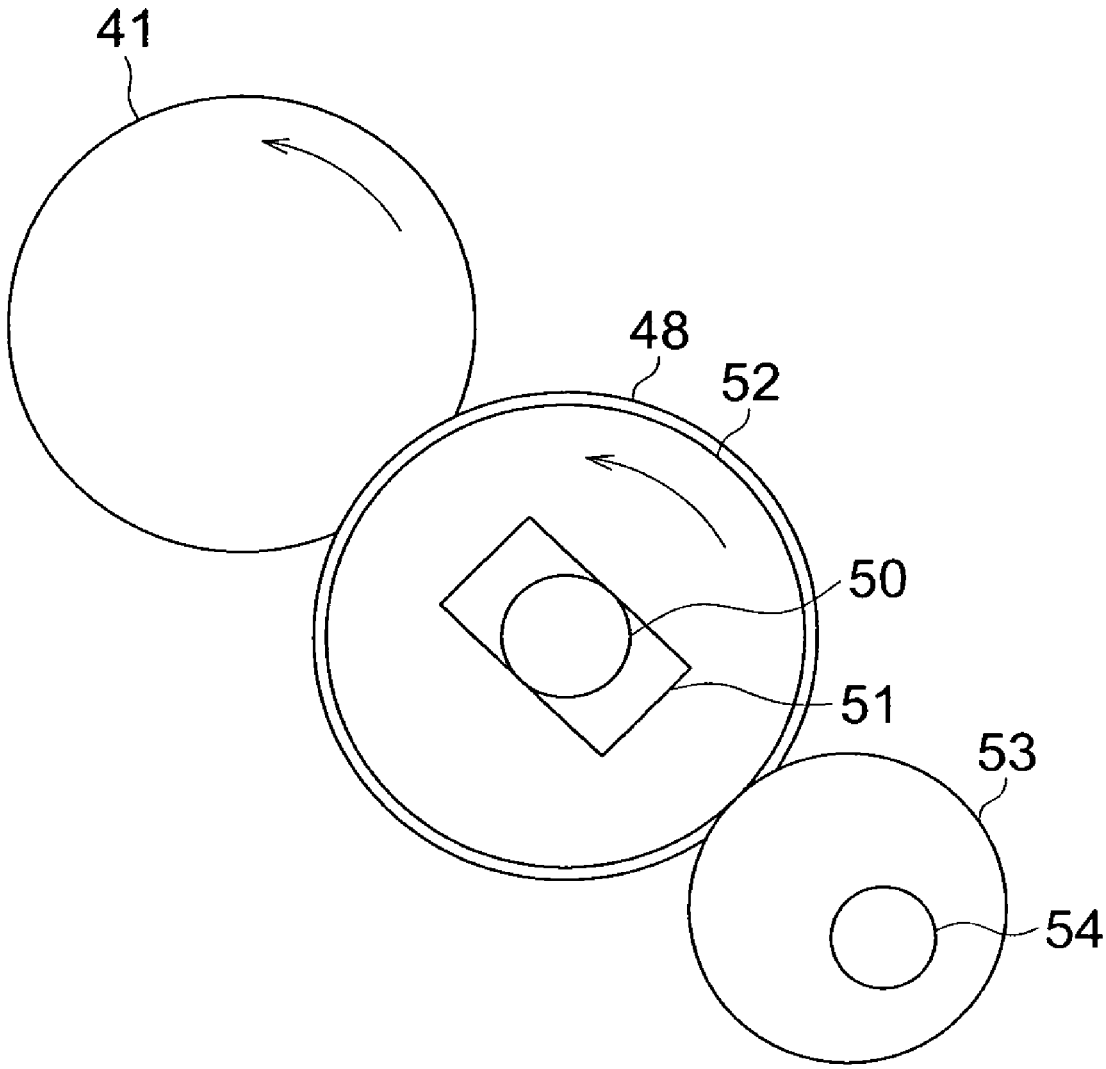
FIG. 7 is a cross sectional view schematically showing an example of a contact pressure adjusting mechanism for adjusting the push-in amount between rollers.
Figure 8:
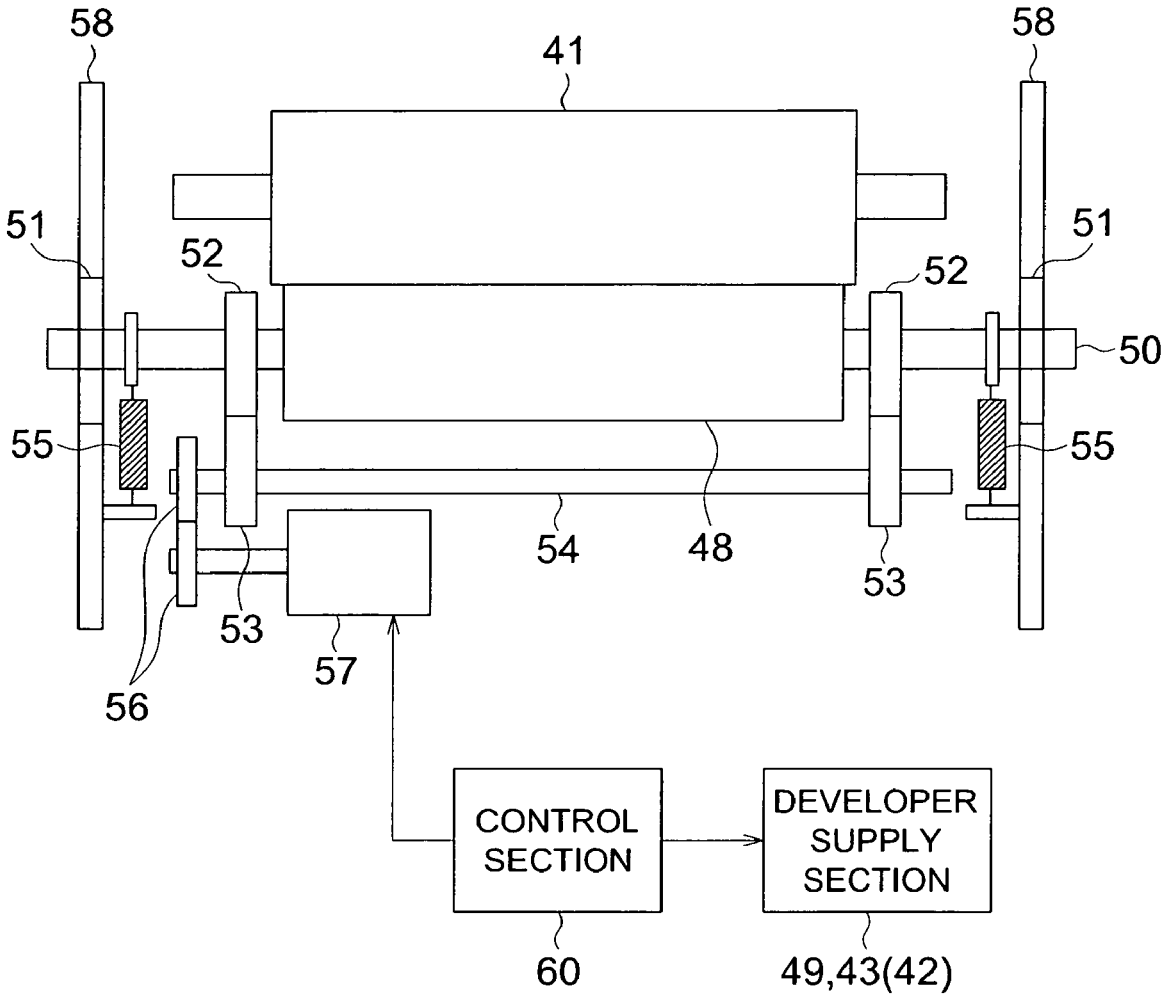
FIG. 8 is a plan view schematically showing the example of the contact pressure adjusting mechanism for adjusting the push-in amount between rollers.

The contact pressure between the rollers can be adjusted, for example, by adjusting the push-in amount between the rollers, using an eccentric cam. Referring to FIGS. 7 and 8, the following describes an example of the contact pressure adjusting mechanism. FIG. 7 is a schematic cross sectional view, and FIG. 8 is a schematic plan view.

The following describes how to adjust the contact pressure between, for example, the developing roller 41 and conveyance roller 48, and therefore, the developer tank 49 and supply roller 47 are not illustrated. Further, the description will be made on the developing device of FIG. 2 or FIG. 3, for the sake of convenience.

To realize modification of the shaft distance between the conveyance roller 48 and developing roller 41, a slot 51 is formed on the side plate 58 of the liquid developing device 4, and a shaft 50 of the conveyance roller 48 is arranged in engagement with the slot 51.

The conveyance roller 48 is urged by a tension spring 55 in the direction of moving apart from the developing roller 41. Further, the rotatably mounted runners 52 are arranged on both sides of the shaft of the conveyance roller 48.

The runner 52 is arranged in contact with an eccentric cam 53 to determine the shaft distance between the conveyance roller 48 and developing roller 41. The eccentric cam 53 is driven by the torque of the motor 57 transmitted by a gear train 56.

Regarding the shaft distance between the conveyance roller 48 and developing roller 41, the push-in amount is controlled by rotating the eccentric cam 53 to adjust the distance by which the runner 52 is pushed toward the developing roller 41.

The amount of rotation of the eccentric cam 53 can be controlled by the number of pulses when a stepping motor is used as the motor 57. The amount of rotation of the eccentric cam 53 can also be controlled by a detection section mounted to detect the shaft position of the conveyance roller 48.

<Contact Pressure Modification Control>

The operation of modifying the contact pressure by the aforementioned contact pressure adjusting mechanism is controlled by the control section 60, as shown in FIG. 8. To be more specific, the motor 57 is controlled to adjust the amount of rotation of the eccentric cam 53 and to modify the push-in amount, whereby the contact pressure between the conveyance roller 48 and developing roller 41 is modified.

The contact pressure can be modified, for example, when the roller cleaning operation is performed as described above. As will be described later, when the image forming operation is suspended, the contact pressure modification operation is controlled simultaneously with various forms of control operations for the roller cleaning operation.

At that time, the control section 60 also controls the supply of liquid developer to stop, if needed. As shown in FIG. 8, the control section 60 controls the developer supply section 49 or 43, or controls the supply by a supply nozzle as required, so that the supply of the developer to the conveyance roller 48 is suspended or restarted.

The method of suspending the liquid developer supply will be described later. The following describes the timing of the contact pressure modification and the procedure of contact pressure modification control.

(Timing of Contact-Rotation and Control of Contact Pressure Modification in the Non-Image Formation Mode)

<Timing of the Roller Cleaning Operation>

A description has been made on the method of modifying the contact pressure using the aforementioned contact pressure adjusting mechanism in the roller cleaning operation mode. The purpose is to make the contact pressure smaller than during the image formation period, in which there is a sufficient amount of liquid developer between the rollers, in order to prevent the roller surfaces getting damaged or the required torque getting increased when the liquid developer on the surface of the rollers rotating in contact is a little or disappears.

To be more specific, the contact pressure must be modified when the contact-rotation is performed without a sufficient amount of liquid developer between the rollers, for example, when the roller is under cleaning after completion of the image formation or others, as described above. The timing set for this purpose will be a first predetermined timing.

The first predetermined timing is exemplified by the time when image formation has been completed. The rollers can be cleaned every time immediately after image formation is completed. The procedure of controlling the contact pressure modification will be described later with reference to FIG. 9.

The first predetermined timing can be defined as the timing when no image has been formed for a predetermined time interval. Alternatively, the first predetermined timing can also be defined as the time immediately before the apparatus power source is turned off. Further, the roller cleaning operation can be performed in response to the input operation by the user through the operation panel or others.

The contact pressure modification control procedure in these cases will be described later with reference to FIG. 10.

<Timing for Preliminary Contact-Rotation for Starting the Image Forming Operation>

The contact pressure must be modified when contact-rotation is performed without a sufficient amount of liquid developer between the rollers. This modification is also required other than when the above-described roller cleaning is performed.

To be more specific, if the cleaning operation has been performed to remove the developer from the roller at the aforementioned timing, and the rollers start rotating in the next image formation step, the rollers will be driven in contact with one another having an insufficient amount of developer in the nip portion between the rollers or having no developer at all. This will raise the same problem.

Thus, preliminary rotation should be performed and the liquid developer should be supplied between the rollers before starting the image forming operation. To be more specific, this is the reverse operation to the roller cleaning operation. For the rotation, the supply of the liquid developer must be started, instead of being suspended.

During the preliminary rotation, the contact pressure must be set to a smaller level on the assumption that a sufficient amount of liquid developer is not yet supplied between the rollers.

The timing set for this preliminary rotation will be defined as a second predetermined timing. The timing corresponding to the aforementioned first predetermined timing should be set as the second predetermined timing.

The second predetermined timing is exemplified, corresponding to the first predetermined timing subsequent to completion of the image forming operation, by the timing prior to the start of the image forming operation.

The second predetermined timing can be the time interval prior to the start of the image forming operation after the image forming operation has not been performed in excess of a predetermined time period. Alternatively, the second predetermined timing can be the timing immediately after the apparatus power has been turned on. Further, the preliminary rotation can be performed in response to the input operation by the user through the operation panel or others.

<Contact Pressure Modification Control at the Time of Roller Cleaning>

Figure 9:
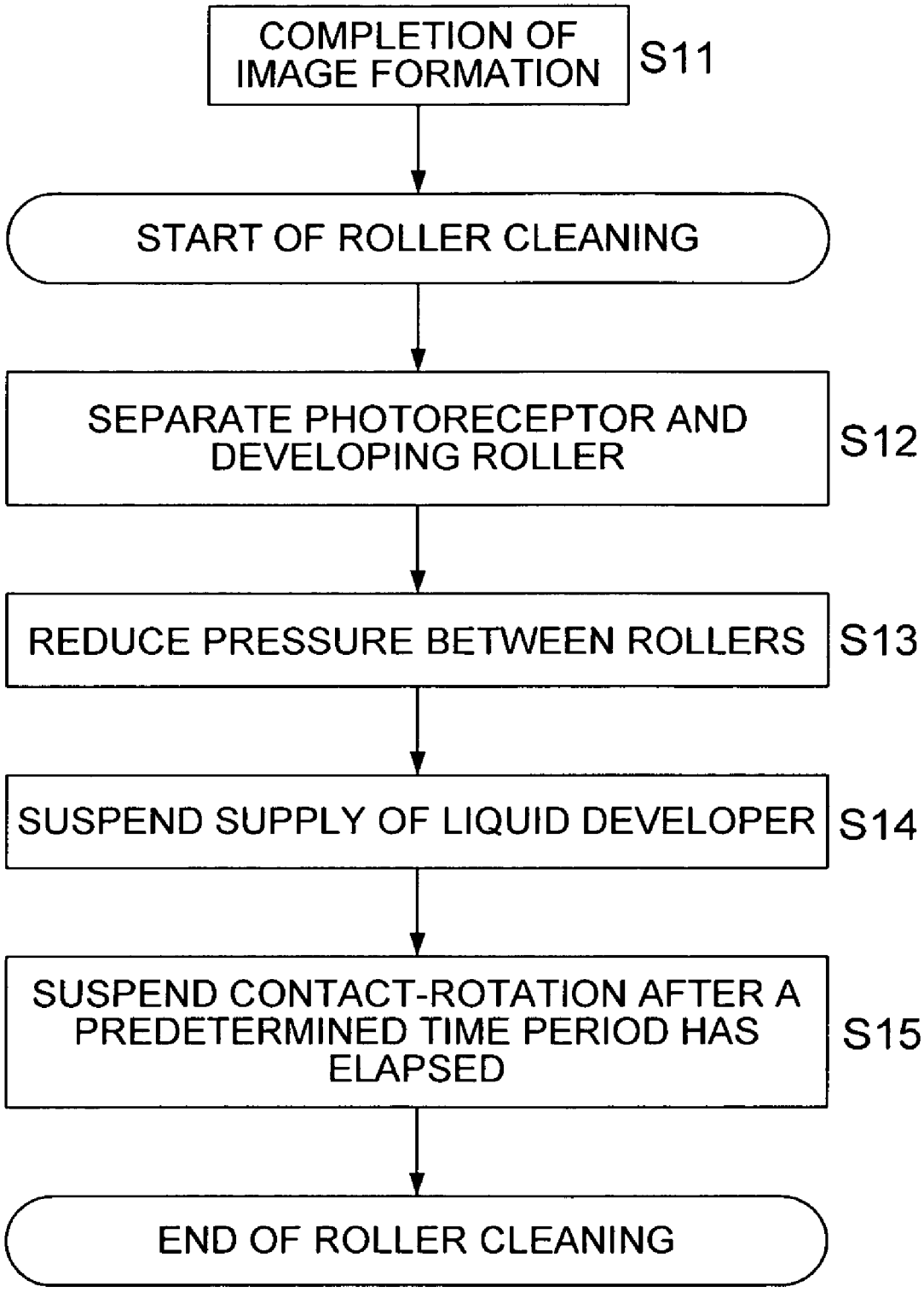
FIG. 9 is a flow chart showing an example of a contact pressure control procedure when the roller cleaning operation is performed subsequent to every image formation.
Figure 10:
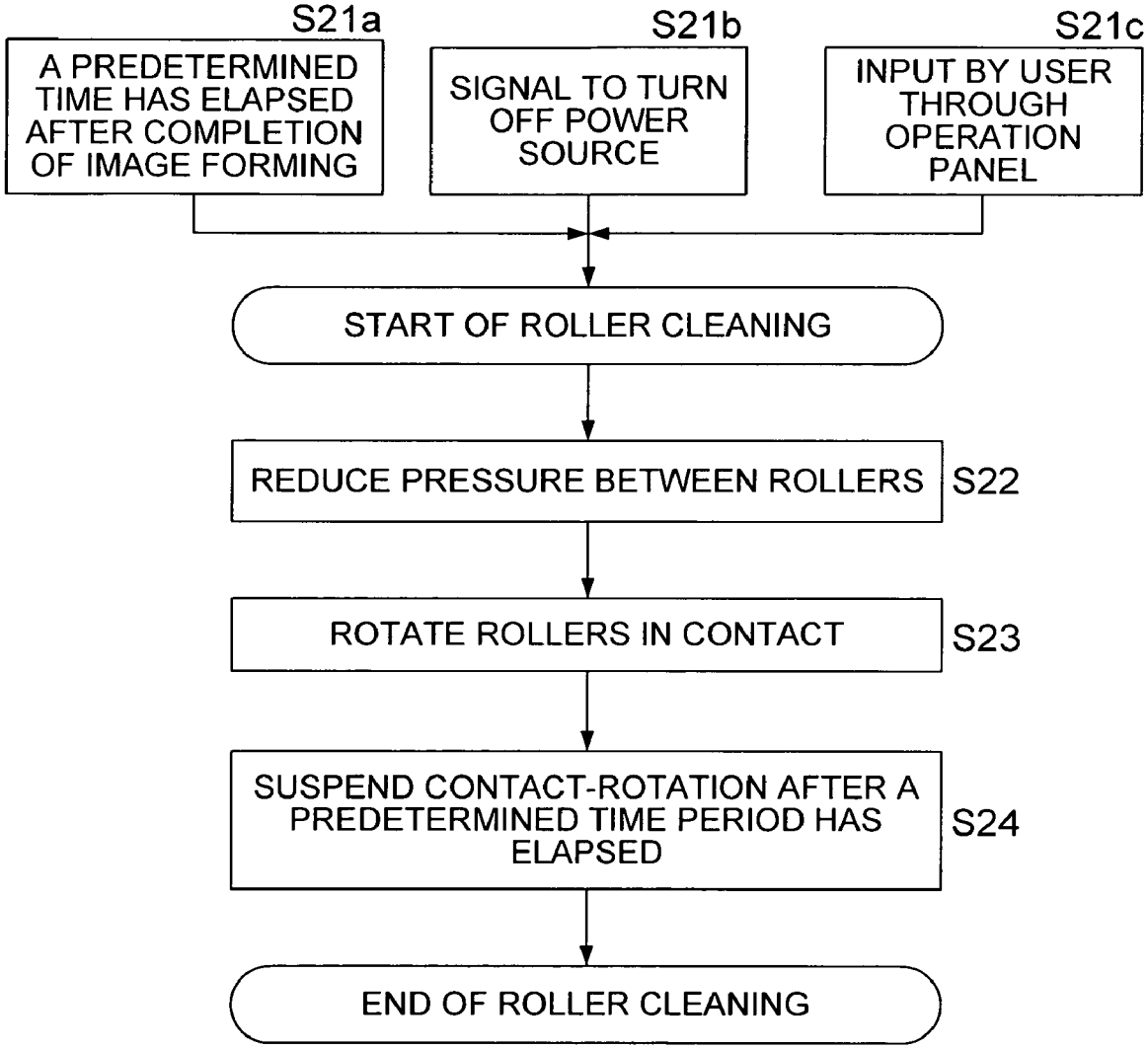
FIG. 10 is a flow chart showing an example of a contact pressure control procedure when the roller cleaning operation is performed after the certain lapse of time from the time of completing image formation, or immediately before the apparatus power is turned off, or in response to the input by the user through the panel.

FIG. 9 and FIG. 10 are the flow charts of an operation for adjusting the contact pressure. FIG. 9 shows the flow when the roller cleaning operation is performed every time after image formation. FIG. 10 shows the flow when the roller cleaning operation is performed after the lapse of a certain time from the time of completing image formation, or immediately before the apparatus power is turned off, or in response to the input by the user through the panel.

Immediately after completion of image formation (Step S11) as shown in FIG. 9, the photoreceptor is kept in contact with the developing roller, and the rollers are rotating. The flow starts when the liquid developer is being supplied. In this situation, the control section 60 moves the photoreceptor apart from the developing roller (Step S12), and causes the contact pressure adjusting mechanism to reduce the contact pressure between rollers (Step S13). After that, the control section 60 controls the developer supply section 49 or 43 to suspend supply of the liquid developer (Step S14).

Under this condition, the control section 60 keeps the roller rotating for more than a predetermined time so that the liquid developer has been sufficiently removed from the roller, and the control section 60 then suspends the rotation (Step S15).

This flow chart shows only one example. To be more specific, this sequence need not always be performed in this order. For example, while the supply liquid developer is suspended, the roller is driven, and the contact pressure between rollers can be reduced gradually with the reduction in the amount of developer on the peripheral surface of each roller.

If the procedure stats when a certain period of time has passed after completion of image forming (Step S21*a*), or immediately before turn off of the apparatus power source (Step S21*b*), or in response to the input operation of the user through the operation panel (Step S21*c*), the procedure starts, as shown in FIG. 10, in the situation where the photoreceptor and the developing roller are separated, the rollers are stopped, and the supply of the liquid developer is suspended.

Thus, the control section 60 causes the contact pressure adjusting mechanism to reduce the contact pressure between the rollers (Step S22), and causes the rollers to rotate for a predetermined time. After the liquid developer has been sufficiently removed from the roller (Step S23), the control section 60 suspends that rotation (Step S24).

In this case as well, for example, the roller can be driven when the supply of liquid developer has been suspended, and the contact pressure between rollers can be gradually reduced with the reduction in the amount of developer on the peripheral surface of each roller.

<How to Suspend the Supply of Developer>

As described above, the supply of liquid developer is suspended by the control section 60 at the time of cleaning. The suspension of supply is performed according to the following procedure.

In the case of the developing device provided with a developer tank 49 shown in FIG. 2, FIG. 4 and FIG. 6, a part of the supply roller 47 is dipped in the liquid developer in the developer tank 49, even when the supply of liquid developer from the supply nozzle 42 is suspended. Thus, to suspend the supply, the supply roller 47 must not be dipped in the liquid developer.

To achieve this situation, for example, the developer tank 49 should be provided with an ejection port (not illustrated) so that the liquid developer is ejected by the negative pressure of a pump. The ejected liquid developer is recovered into a developer storage tank (not illustrated) through a duct.

To have the supply roller 47 not dipped in the liquid developer, the developer tank 49 can be moved away from the supply roller 47.

In the meantime, in the case of the developer tank 49 not equipped with the developing device, as in FIG. 3 and FIG. 5, if the supply from supply nozzle 42 is suspended, the liquid developer of the liquid developer reservoir in a wedge-like shape formed between the developer supply blade 43 and supply roller 47 is swiftly shifted to the supply roller 47 with the rotation of the roller. This arrangement eliminates the need of ejection of the liquid developer from the developing device.

Alternatively, if a proper gap is provided between the leading edge of the supply blade 43 and the supply roller 47, the liquid developer can swiftly go down through this gap, with the result that the liquid developer reservoir will disappear.

According to the image forming apparatus and method for image forming in the present embodiment, a developing device using a liquid developer is provided with a contact pressure modification section that modifies the contact pressure in the contact region between the rollers that are driven in contact with one another. The contact pressure in the contact region is modified to be smaller than the contact pressure in the contact region in the image formation mode, when the step is taken to remove the developer using the rotation of rollers in contact with one another, and the supply of the liquid developer is suspended in the non-image formation mode.

This arrangement ensures the developer to be removed sufficiently from the roller by the operation of removing developer, and eliminates the possibility of a failure being caused by sticking of toner. Moreover, this arrangement maintains high image quality over a long period of time, without the roller surface being damaged or the required drive torque being increased.

EXAMPLES

The following test has been conducted using the wet type image forming apparatus of FIG. 1, and the advantages thereof have been verified. In the first place, the following describes the test conditions.

(Developer)

The following procedure was used to prepare the liquid developer that had been employed.

100 parts by mass of polyester resin was sufficiently mixed with 15 parts by mass of copper phthalocyanine using a Henschel mixer. After that, the mixture was fused and mixed by using a same-direction twin-screw extruder at a heating temperature of 100° C. inside the roll. The resulting mixture was cooled and crushed to obtain roughly crushed toner.

75 parts by mass of Moresco White P40 (Matsumura Petroleum Research), 25 parts by mass of the aforementioned roughly crushed toner, and 0.8 parts by mass of dispersant V220 (ISP) were mixed. The mixture was subjected to a wet pulverization step by a sandmill for four days to obtain liquid developer. The particle size of this mixture was 2.0 μm. The particle size was measured by a laser diffraction type particle size distribution measuring instrument SALD-2200 (Shimadzu Seisakusho Ltd.).

(Developing Device)

The liquid developing device 4 used in the test was of the type shown in FIG. 2. The following describes the conditions for each roller.

<Developing Roller>

The developing roller 41 had a diameter of 40 mm, and was made of NBR impregnated with carbon black. The volume resistivity was $1.0\times10^6$ Ω·cm, and the rubber hardness was 40 degrees.

The peripheral speed of rotation was set at 420 mm/sec, and a bias voltage of +300V was applied.

<Cleaning Blade>

A 3 mm thick urethane rubber blade was used as the cleaning blade 46 for the developing roller 41. This blade was arranged in contact at a counter angle of 20 degrees with respect to the tangential line of the developing roller 41. The pressing force was 30 N/m.

<Conveyance Roller>

The conveyance roller 48 had a diameter of 40 mm, and was made of NBR impregnated with carbon black. The volume resistivity was $1.0\times10^6$ Ω·cm, and the rubber hardness was 60 degrees.

The peripheral speed ratio (θ) with respect to the developing roller 41 was set at 1.5. The push-in amount with respect to the developing roller 41 was variable in the range of 0.05 mm through 0.3 mm.

The push-in amount was controlled by a position control method using an eccentric cam (structure of FIGS. 7 and 8), whereby the contact pressure was adjusted.

<Supply Roller>

An anilox roller having a diameter of 40 mm was used as the supply roller 47. The anilox roller is designed in a grid-like structure of 200 lines per inch. The groove had a capacity of 20 ml/m$^2$.

The peripheral speed was the same as that of the conveyance roller 48. The push-in amount was set at 0.1 mm.

A 0.3 mm thick stainless steel blade was used as the developer regulating blade 44.

(Intermediate Transfer Member)

The intermediate transfer member 5 had a diameter of 100 mm, and made of an urethane rubber base member with 5 mm thickness covered with a 0.03 mm urethane coating.

Example 1

A Roller cleaning operation was performed every time, according to the flow of FIG. 9 under the aforementioned apparatus conditions, immediately after completion of the image formation for each job.

The setting was modified in such a way that the push-in amount between the developing roller and conveyance roller was 0.3 mm during image formation, and 0.05 mm during the roller cleaning operation. They correspond to a linear pressure (contact pressure) between the rollers of approximately 100 N/m during image formation, and approximately 10 N/m during the roller cleaning operation, respectively.

Further, in the case where the roller cleaning operation has been performed, when the roller drive was to start for the next forming operation, the push-in amount between the developing roller and conveyance roller remained 0.05 mm. The push-in amount was then increased up to the same amount (0.3 mm) as during image formation, with the supply of liquid developer on the peripheral surface of each roller.

Assuming actual use, a long-term durability test was conducted under the aforementioned conditions. The image forming operation for 100 A4 sheets was assumed as one job, and 100 jobs (a total of 10,000 sheets) were printed out on the first day. For the next six days, the apparatus was left unused. On the next day, 10,000 sheets were printed out again, and the apparatus was left unused for the next six days. In this mode of usage, a durability test was conducted for two months.

As a result, both in the initial period and two months later, there were no image defects that were thought to have been created by the damage on the roller surface or the sticking of toner. A high image quality was maintained for a long period of time.

Comparative Example 1

The Comparative Example 1 is the same as Example 1, except that the roller cleaning operation was not performed. Namely, toner remained on the roller when the apparatus was left unused.

In the same manner as that of Example 1, a durability test was conducted for two months under such conditions. As a result, irregular image density was observed in the printings after the apparatus was left unused for the first six days. Examination of the cause of this trouble has revealed that toner was stuck to the developing roller and conveyance roller.

Comparative Example 2

Comparative Example 2 is the same as Example 1, except that the push-in amount between the developing roller and conveyance roller was kept constant at 0.3 mm in Comparative Example 2.

In the same manner as that of Example 1, a durability test was conducted for two months under such conditions. As a result, streaks of image noise were observed in the printings on the 15th day including the days when the apparatus was left unused. Examination of the cause of this trouble has revealed that the surface of the developing roller was damaged, and this trouble caused a cleaning failure.

Example 2

Example 2 is the same as the Example 1, except that the roller cleaning operation was performed when image output has not been performed for more than a predetermined time period. To be more specific, the roller cleaning operation was performed according to the flow of FIG. 10 if there was no printing instruction for more than one hour after completion of the last job (this case was scheduled to occur every 20 jobs).

In the same manner as that of Example 1, a durability test was conducted for two months under such conditions. As a result, in the initial period and two months later, there were no image defects that could have been created by the damage on the roller surface or the sticking of toner. A high image quality was maintained for a long period of time.

Example 3

Example 3 is the same as Example 1, except that the roller cleaning operation was performed immediately before the power source was turned off. When the power off instruction was given by the user, the roller cleaning operation was performed according to the flow of FIG. 10. (In this case, the power was turned off upon completion of the final job of one day).

In the same manner as that of Example 1, a durability test was conducted for two months under such conditions. As a result, in the initial period and two months later, there were no image defects that could have been created by the damage on the roller surface or the sticking of toner. A high image quality was maintained for a long period of time.

Example 4

Example 4 is the same as Example 1, except that the contact pressure between the rollers was gradually reduced during the roller cleaning operation. A stepping motor was used to ensure accurate control of the eccentric cam position, whereby the push-in amount (contact pressure) was changed as follows: Namely, in the first phase of the roller cleaning operation, the push-in amount was 0.3 mm, the same amount as during image formation. While the roller was driven for five seconds, the push-in amount was reduced to 0.05 mm. Then the roller was driven for another five seconds with this push-in amount kept unchanged.

In the same manner as that of Example 1, a durability test was conducted for two months under such conditions. As a result, in the initial period and two months later, there were no image defects that could have been created by the damage on the roller surface or the sticking of toner. A high image quality was maintained for a long period of time.

According to the image forming apparatus of the present embodiment, a developing device using a liquid developer includes a contact pressure modification section to modify the contact pressure in the contact region between the rollers driven in contact with one another. When operation is performed to remove the developer using the contact-rotation between rollers with the supply of liquid developer being suspended in the non-image formation mode, the modification is made to ensure that the contact pressure in the contact region is smaller than that during image formation.

This arrangement ensures that the developer is sufficiently removed from the roller surface by the aforementioned operation of removing the developer, and eliminates the possibility of a failure being caused by the sticking of toner. Moreover, high image quality can be maintained for a long period of time, without the roller surface being damaged or the required drive torque being increased.

It should be noted that the aforementioned embodiment is illustrative in all respects, and not restrictive. It is intended that the scope of the present invention is represented not by the aforementioned description but by the Claims, and includes the meaning equivalent to the Claims and all the modifications within the scope of the Claims.

What is claimed is:

1. An image forming apparatus, comprising:

an image carrying member for carrying an electrostatic latent image formed thereon;

a developing device, the developing device including:

a developer supply section for supplying liquid developer containing solvent and toner dispersed in the solvent;

a developing roller for carrying on a surface thereof a thin layer of the liquid developer to develop the electrostatic latent image on the image carrying member;

a thin layer forming roller for transferring the liquid developer supplied from the developer supply section to the developing roller so that the developing roller carries thereon the thin layer of the liquid developer, the developing roller and the thin layer forming roller rotating in contact with each other during an image forming period in which an image forming operation is performed; and a cleaning member for removing the liquid developer from the surface of the developing roller;

a contact pressure modification section for modifying a contact pressure in a contact region in which the developing roller contacts with the thin layer forming roller; and a control section for causing, at a first timing outside the image forming period, the contact pressure modification section to modify the contact pressure in the contact region to be lower than during the image forming period while the developing roller and the thin layer forming roller are kept rotating in contact with each other and the supply of the liquid developer by the developer supply section is suspended.

2. The image forming apparatus of claim 1, wherein after the contact pressure has been modified at the first timing, the control section causes the contact pressure modification section to modify the contact pressure in the contact region to a reduced amount with the rotation of the developing roller and the thin layer forming roller in contact with each other.

3. The image forming apparatus of claim 1, wherein the first timing is when the image forming operation is finished.

4. The image forming apparatus of claim 1, wherein the first timing is when a predetermined period of time or longer has passed since the image formation was last performed.

5. The image forming apparatus of claim 1, wherein the control section causes the contact pressure modification section to modify the contact pressure at the first timing immediately before the control section turns off a power source of the apparatus.

6. The image forming apparatus of claim 1, wherein the control section causes, at a second timing outside the image forming period, the contact pressure modification section to modify the contact pressure in the contact region to be lower than during the image forming period while the developing roller and the thin layer forming roller are kept rotating in contact with each other with the liquid developer being supplied by the developer supply section.

7. The image forming apparatus of claim 6, wherein the second timing is immediately before the image forming operation starts.

8. The image forming apparatus of claim 6, wherein the second timing is after a predetermined period of time has passed from a latest completion of the image forming operation and before an image forming operation starts.

9. The image forming apparatus of claim 6, wherein the second timing is immediately after a power supply of the apparatus is turned on.

10. A method for forming an image by using an image forming apparatus having: an image carrying member for carrying an electrostatic latent image formed thereon; a developer supply section for supplying liquid developer containing solvent and toner dispersed in the solvent; a developing roller for carrying on a surface thereof a thin layer of the liquid developer to develop the electrostatic latent image on the image carrying member; a thin layer forming roller for transferring the liquid developer supplied from the developer supply section to the developing roller so that the developing roller carries thereon the thin layer of the liquid developer, the developing roller and the thin layer forming roller rotating in contact with each other during an image forming period in which an image forming operation is performed; a cleaning member for removing the liquid developer from the surface of the developing roller; and a contact pressure modification section for modifying a contact pressure in a contact region in which the developing roller contacts with the thin layer forming roller, the method comprising the steps of:

causing, outside the image forming period, the cleaning member to remove the liquid developer on the developing roller while the developing roller and the thin layer forming roller are kept rotating in contact with each other with the supply of the liquid developer by the developer supply section being suspended; and modifying, at a first timing in the step of causing the cleaning member to remove the liquid developer, the contact pressure in the contact region between the developing roller and the thin layer forming roller to be lower than during the image forming period.

11. The method of claim 10, comprising the steps of:

rotating, outside the image forming period, the developing roller and the thin layer forming roller in contact with each other with the liquid developer held therebetween while the liquid developer is being supplied by the developer supply section; and modifying, at a second timing in the step of rotating the developing roller and the thin layer forming roller, the contact pressure in the contact region between the developing roller and the thin layer forming roller to be lower than during the image forming period.

* * * * *